United States Patent [19]

Ehnström

[11] Patent Number: 4,662,867

[45] Date of Patent: May 5, 1987

[54] OUTLET ARRANGEMENT FOR CENTRIFUGES

[75] Inventor: Lars Ehnström, Tullinge, Sweden

[73] Assignee: Alfa-Laval AB, Tumba, Sweden

[21] Appl. No.: 804,390

[22] Filed: Dec. 4, 1985

[30] Foreign Application Priority Data

Dec. 12, 1984 [SE] Sweden ..... 8406333

[51] Int. Cl.[4] ..... B04B 13/00

[52] U.S. Cl. ..... 494/56

[58] Field of Search ..... 494/1, 2, 3, 4, 6, 8–11, 494/37, 56–59, 84, 85, 23; 422/72; 210/360.1; 366/184

[56] References Cited

U.S. PATENT DOCUMENTS

| | | | |
|---|---|---|---|
| 3,580,493 | 5/1971 | Jonsson | 494/2 |
| 3,750,940 | 8/1973 | Raymond | 494/3 |
| 3,752,389 | 8/1973 | Raymond | 494/3 |
| 3,960,319 | 6/1976 | Brown | 494/2 |
| 4,151,950 | 5/1979 | Gunnewig | 494/2 |
| 4,411,645 | 10/1983 | Tenthoff | 494/10 |

*Primary Examiner*—Robert W. Jenkins

*Attorney, Agent, or Firm*—Cyrus S. Hapgood

[57] ABSTRACT

In a centrifugal separator an outlet member (9) is rotatably arranged within the centrifuge rotor (1, 2) such that it can be entrained in rotation by liquid having been supplied to the rotor. The outlet member (9) forms a groove (13) which is open towards the rotor axis and in which there opens an outlet channel (11) starting in the part of the rotor which contains, during operation of the rotor, a separated liquid component. A non-rotatable outlet member (7) has at least one outlet passage (8), one end of which opens in said groove (13) at a level where separated liquid component will be present during operation of the rotor only when the rotatable outlet member (9) is caused to rotate with a certain lower speed than the liquid within the rotor.

7 Claims, 2 Drawing Figures

OUTLET ARRANGEMENT FOR CENTRIFUGES

Figure 1:
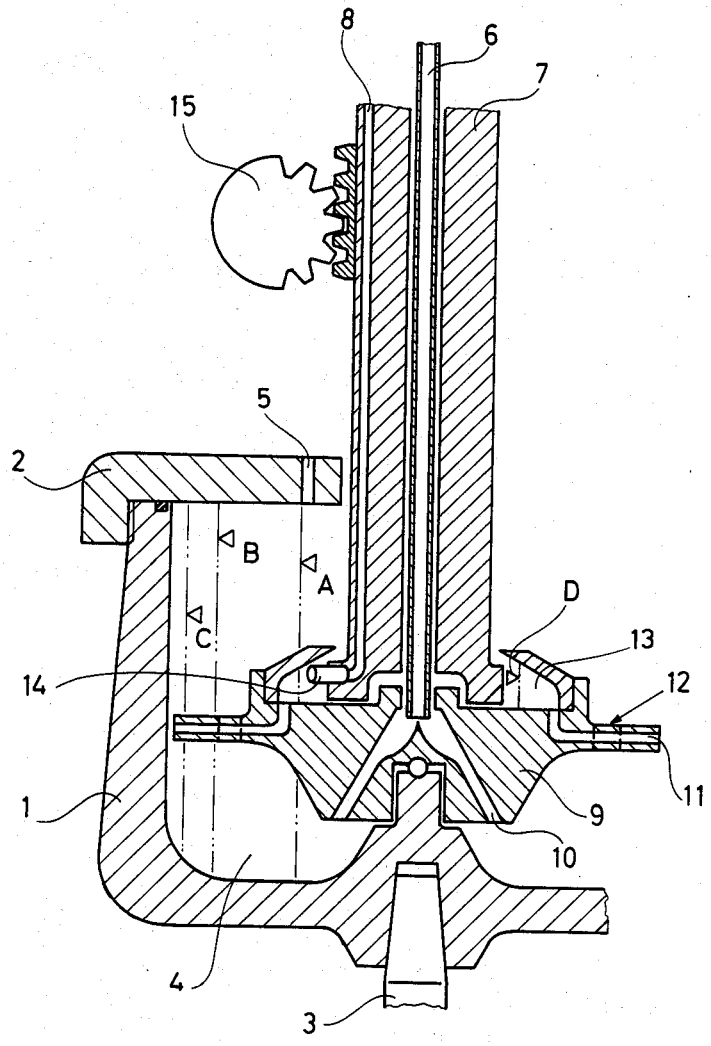

The present invention relates to centrifugal separators of the kind comprising a rotor with a separation chamber, means for supplying a liquid mixture into the rotor, and a non-rotatable outlet member with at least one outlet passage for discharge of a separated liquid from the rotor during its rotation.

An outlet arrangement often used in connection with previously known centrifugal separators of this kind comprises a stationary so-called paring member. A member of this kind extends into the rotor of the centrifugal separator to a desired radial level below the surface of the separated liquid to be discharged. One advantage of an outlet arrangement of this kind is that the separated liquid may be discharged with an overpressure, i.e., the rotor and the non-rotatable member work as a pump (centripetal pump).

A disadvantage of an outlet arrangement of the described kind is that the non-rotatable outlet member causes a relatively large friction at its contact with the separated liquid in the rotor. This is energy-consuming and may cause an undesired heating of the separated liquid. Outlet arrangements comprising stationary paring members, for this reason, are not always suitable in connection with centrifugal separators, the rotors of which are intended for very high rotational speeds.

The principal object of the present invention is to provide an outlet arrangement for centrifugal separators of the above-noted kind which operates as a pump but still causes a relatively small energy consumption and substantially less heating of the separated liquid to be discharged than an outlet arrangement of the previously known kind.

This object is achieved according to the invention by an outlet arrangement comprising, in addition to the aforementioned non-rotatable outlet member with its outlet passage, an outlet member which is rotatable relative to the rotor and which has at least one part so arranged within the rotor that the rotatable outlet member will be entrained in rotation by liquid present in the rotor; an annular groove which is formed by the rotatable outlet member and which is open towards the axis of the rotor; a channel in the rotatable outlet member, which extends from a place in the rotor where separated liquid is present during the operation of the rotor, to said annular groove; and means for intermittent counteraction of the entrainment of the rotatable outlet member by the rotating liquid to an extent such that separated liquid will flow through said channel to the annular groove, a part of the non-rotatable outlet member which has the inlet opening of said outlet passage being situated in the annular groove at a radial level where separated liquid will be present only during said intermittent counteraction of the rotation of the rotatable outlet member.

By means of an outlet arrangement according to the invention it is possible to limit the energy consumption and the heating of the non-rotatable outlet member to short time intervals, when separated liquid is removed from the rotor. The non-rotatable outlet member thus need not be continuously immersed in the separated liquid rotating within the rotor.

In principle, the outlet passage or passages in the non-rotatable outlet member may open radially in the annular groove, but preferably the non-rotatable outlet member comprises a paring member, for instance a paring disc, in which the outlet passages open in the groove in a way such that the rotational movement energy of the separated liquid will be used for the discharge of the liquid from the rotor.

According to a preferred embodiment of the invention, the annular groove is situated within the rotor. If desired, however, the rotatable outlet member may extend out of the rotor, and the annular groove may be formed in the part of the outlet member situated outside the rotor.

Figure 2:
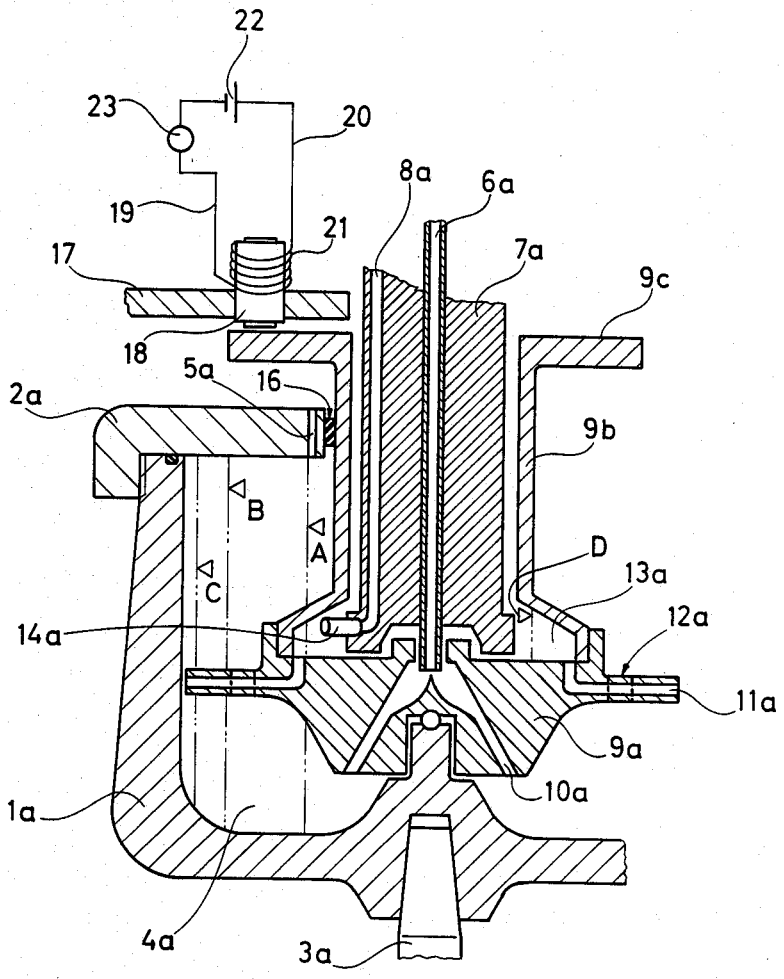

The invention is described more fully in the following with reference to the accompanying drawings in which FIGS. 1 and 2 are sectional views of two different embodiments thereof.

In FIG. 1 there is shown a centrifuge rotor consisting of two parts 1 and 2. The rotor is supported by a vertical drive shaft 3 which is connected with the lower rotor part 1. Within the rotor there is confined a separation chamber 4 which has an overflow outlet in the form of a number of openings 5 in the upper rotor part 2.

Extending centrally into the rotor is an inlet pipe 6 which is surrounded by an axially movable but non-rotatable outlet member 7. Through the outlet member 7 extend one or more outlet passages 8.

Within the rotor there is journalled a rotatable outlet member 9. This has a number of channels 10 arranged to receive a liquid mixture from the inlet pipe 6 and to forward it to the separation chamber 4 of the rotor. The outlet member 9 also has a number of outlet channels 11, which extend radially inward from the peripheral portion of the outlet member 9 towards the rotor axis. Between the outlet channels 11 the outlet member 9 has several axially extending through bores 12, which connect different parts of the separation chamber 4 with each other.

At a distance radially inside the bores 12, the outlet member 9 forms an annular groove 13 which is open towards the axis of the rotor. The outlet channels 11 open into the radially outermost part of the groove 13.

At a level radially inside the openings of the channels 11 into the groove 13 there is present—within the groove 13—the part of the non-rotatable outlet member 7 which has the inlet openings of the outlet passages 8. Each of these openings is formed by a short piece of tubing 14, which is carried by the outlet member 7. Each piece of tubing 14 is bent so that it can operate as a paring member in the groove 13.

A toothed device 15 meshes with teeth on the non-rotatable outlet member 7 and is rotatable to move the latter to and from frictional engagement with the rotatable outlet member 9.

In FIG. 1 there are shown by dash-dot lines four radial levels A, B, C and D in the rotor. The arrangement according to FIG. 1 operates in the following manner: Through stationary pipe 6 there is supplied batchwise or continuously a liquid mixture of components to be separated in the rotor. Relatively heavy component is collected at the periphery of the separation chamber, whereas relatively light component is collected nearer to the rotor axis. A free liquid surface of relatively light component is formed at the level A, and upon continued supply of mixture through the pipe 6, separated light component will leave through the openings 5.

When separation chamber 4 is filled, the outlet member 9 is entrained in the rotation of the supplied liquid. If the liquid supply is interrupted, the entrainment will be substantially complete. If a relatively large liquid supply is maintained, the outlet member 9 will rotate with somewhat lower speed than the liquid within the separation chamber 4. In the latter case a free liquid surface will be formed in the groove 13 at a level somewhat inside the level A but radially outside the pieces of tubing 14.

After some time of operation of the rotor, an interface layer between separated light component and separated heavy component has moved radially inward to the level B in the separation chamber 4. If at this stage separated heavy component is to be removed from the rotor, the non-rotatable outlet member 7 is moved axially by device 15 against the rotatable outlet member 9, until the rotation of the latter is counteracted to a desired degree by arising friction. Thus, the absolute pressure of the liquid present within the outlet channels 11 will be decreased, and a flow of separated heavy component will come up radially inward through the channels 11 to the groove 13. The liquid surface in the groove 13 then moves radially inward to the level D, so that the pieces of tubing 14 will partly be covered by liquid. As a result, separated heavy liquid will flow out of the rotor through the outlet passages 8 in the non-rotatable outlet member 7.

After a predetermined time, the non-rotatable outlet member 7 is moved axially away from the rotating outlet member 9, so that the rotational speed of the latter increases again. This means that part of the separated heavy component, which is situated in the groove 13, flows back radially outward through the channels 11, the liquid surface in the groove 13 then moving to a level radially outside the pieces of tubing 14.

During the time that the rotation of the outlet member 9 has been counteracted, the interface layer between separated light component and separated heavy component has moved in the separation chamber 4 radially outward to the level C. As can be seen, at this stage the inlet opening of the outlet channels 11 is still situated in the part of the separation chamber 4 which is filled with separated heavy component. Separated light liquid component thus cannot flow in through the channels 11 to the groove 13. At the next occasion when separated heavy component is to be removed from the rotor, there is thus only this kind of component present in the channels 11 and the groove 13.

The movement of said interface layer from the level B to the level C may be made directly dependent upon the amount of liquid leaving the rotor. This amount may be determined in any suitable way. For instance, the outlet passages 8 may have calibrated restrictions which during a predetermined period of time—under the prevailing conditions—will let through a predetermined amount of liquid.

In FIG. 2 there is shown a second embodiment of the invention. Details of this embodiment having direct counterparts in the embodiment according to FIG. 1 have the same reference numerals with the addition of "a".

In the embodiment of FIG. 2, the non-rotatable outlet member 7*a* is completely stationary, i.e., it is not intended to be moved axially. Further, the rotatable outlet member 9*a* is provided with a tubular portion 9*b* which extends out of the rotor and, outside the rotor, carries an annular flange 9*c* . At 16 there is shown schematically a bearing arranged between the tubular portion 9*b* and the rotor part 2*a*.

Carried by a frame 17 is a so-called eddy-current brake 18, by means of which the rotational speed of the annular flange 9*c*—and thereby of the rotatable outlet member 9*a*—may be reduced. For this reason, the flange 9*c* consists of some suitable metallic material. Wires 19 and 20 are connected to a coil 21 in the eddy-current brake 18 and to a source of current 22. An instrument 23 in the circuit 19–22 is arranged for setting a desired effect of the eddy-current brake 18.

The rotor according to FIG. 2 operates in the same manner as the rotor in FIG. 1. The only difference is that the rotational entrainment of the outlet member 9*a* is counteracted by means of an eddy-current brake instead of by axial movement of a non-rotatable outlet member.

In both of the illustrated embodiments of the invention, the reduction of the rotational speed of the rotatable outlet member may be initiated automatically, either at certain time intervals by means of a timer, or by means of a device of any suitable kind arranged for indicating when the interface layer between separated heavy component and separated light component has reached a certain level in the separation chamber of the rotor.

In both of the illustrated embodiments of the invention, it is the relatively heavy separated liquid component that is removed intermittently through the two outlet members 7 and 9, or 7*a* and 9*a*, respectively. Of course, the same arrangement can be used for removal of a separated light liquid component in the rotor.

I claim:

1. In combination with a centrifugal separator having a rotor (1–2) forming a separation chamber (4) and rotatable on an axis, means (6) for supplying a liquid mixture to said chamber, and a non-rotatable outlet member (7) with an outlet passage (8) for discharging a separated liquid from the rotor during its operation, the improvement comprising a second outlet member (9) rotatable relative to the rotor and positioned to be entrained in rotation by liquid in the rotor, said rotatable outlet member (9) forming an annular groove (13) which opens toward said axis, said rotatable member (9) having a channel (11) extending to said annular groove (13) from a place in the rotor where separated liquid is situated during operation of the rotor, and means (15, 17–21) for intermittently counteracting the entrainment of said rotatable outlet member (9) by the rotating liquid to an extent sufficient to cause separated liquid to flow through said channel (11) to the annular groove (13), said outlet passage (8) having an inlet opening in a part (14) of said non-rotatable outlet member (7), said part being situated in the annular groove (13) at a radial level where separated liquid will be present only during said intermittent counteracting of said entrainment of the rotatable outlet member (9).

2. The combination of claim 1, in which said part (14) is a paring member.

3. The combination of claim 1 or 2, in which said annular groove (13) is situated within the rotor.

4. The combination of claim 1 or 2, in which all parts of said channel (11) are located radially outside said part of the non-rotatable outlet member (7) which is situated in the annular groove (13).

5. The combination of claim 1 or 2, in which said non-rotatable outlet member (7) is movable axially of the rotor, said counteracting means including a device (15) for moving said non-rotatable member (7) axially into and from frictional engagement with said rotatable outlet member (9).

6. The combination of claim 1 or 2, in which said counteracting means include a brake (18) operable on said rotatable outlet member (9).

7. The combination of claim 6, in which said rotatable outlet member (9) has a portion (9*c*) located outside the rotor, said brake (18) being situated outside the rotor and operable on said portion (9*c*).

* * * * *